US006995640B2

(12) United States Patent
Harmon et al.

(10) Patent No.: US 6,995,640 B2
(45) Date of Patent: Feb. 7, 2006

(54) PRESSURE SENSITIVE TRIP MECHANISM FOR CIRCUIT BREAKERS

(75) Inventors: Jason Harmon, Bristol, CT (US); Gary Douville, West Hartford, CT (US); Jayanath Jayanthan, Muthukulam, South (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/709,531

(22) Filed: May 12, 2004

(65) Prior Publication Data

US 2004/0239458 A1 Dec. 2, 2004

Related U.S. Application Data

(63) Continuation-in-part of application No. 10/248,912, filed on Feb. 28, 2003, now Pat. No. 6,919,785, which is a continuation of application No. 09/682,319, filed on Aug. 20, 2001, now Pat. No. 6,542,057, which is a continuation of application No. 09/571,810, filed on May 16, 2000, now Pat. No. 6,373,357.

(51) Int. Cl.
*H01H 9/00* (2006.01)

(52) U.S. Cl. ..... 335/172; 218/154; 335/165

(58) Field of Classification Search ..... 335/6, 335/16, 17, 202, 165–176, 147, 195, 8–10; 218/151–157

See application file for complete search history.

(56) References Cited

U.S. PATENT DOCUMENTS

| | | | |
|---|---|---|---|
| 2,340,682 | A | 2/1944 | Powell |
| 2,719,203 | A | 9/1955 | Gelzheiser et al. |
| 2,937,254 | A | 5/1960 | Ericson |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,517,356 | A | 6/1970 | Hanafusa |
| 3,803,455 | A | 4/1974 | Willard |
| 3,883,781 | A | 5/1975 | Cotton |
| 4,129,762 | A | 12/1978 | Bruchet |
| 4,144,513 | A | 3/1979 | Shafer et al. |
| 4,158,119 | A | 6/1979 | Krakik |
| 4,165,453 | A | 8/1979 | Hennemann |
| 4,166,988 | A | 9/1979 | Ciarcia et al. |
| 4,220,934 | A | 9/1980 | Wafer et al. |
| 4,255,732 | A | 3/1981 | Wafer et al. |
| 4,259,651 | A | 3/1981 | Yamat |
| 4,263,492 | A | 4/1981 | Maier et al. |
| 4,276,527 | A | 6/1981 | Gerbert-Gaillard et al. |
| 4,297,663 | A | 10/1981 | Seymour et al. |
| 4,301,342 | A | 11/1981 | Castonguay et al. |
| 4,360,852 | A | 11/1982 | Gilmore |

(Continued)

FOREIGN PATENT DOCUMENTS

| | | | |
|---|---|---|---|
| BE | 819 008 | A | 12/1974 |

(Continued)

*Primary Examiner*—Lincoln Donovan
(74) *Attorney, Agent, or Firm*—Cantor Colburn LLP

(57) ABSTRACT

A circuit breaker having a set of electrical contacts, a first actuator in fluid communication with the set of electrical contacts, a second actuator in operable communication with the first actuator, and an operating mechanism in operable communication with the set of electrical contacts and the second actuator is disclosed. Pressurized gas created by separation of the set of electrical contacts acts on and drives the first actuator, which acts on and drives the second actuator, which effectuates tripping of the operating mechanism.

20 Claims, 7 Drawing Sheets

U.S. PATENT DOCUMENTS 4,368,444 A 1/1983 Preuss et al.
4,375,021 A 2/1983 Pardini et al.
4,375,022 A 2/1983 Daussin et al.
4,376,270 A 3/1983 Staffem
4,383,146 A 5/1983 Bur
4,392,036 A 7/1983 Troebel et al.
4,393,283 A 7/1983 Masuda
4,401,872 A 8/1983 Boichot-Castagne et al.
4,409,573 A 10/1983 DiMarco et al.
4,435,690 A 3/1984 Link et al.
4,467,297 A 8/1984 Boichot-Castagne et al.
4,468,645 A 8/1984 Gerbert-Gaillard et al.
4,470,027 A 9/1984 Link et al.
4,479,143 A 10/1984 Watanabe et al.
4,488,133 A 12/1984 McClellan et al.
4,492,941 A 1/1985 Nagel
4,541,032 A 9/1985 Schwab
4,546,224 A 10/1985 Mostosi
4,550,360 A 10/1985 Dougherty
4,562,419 A 12/1985 Preuss et al.
4,589,052 A 5/1986 Dougherty
4,595,812 A 6/1986 Tamaru et al.
4,611,187 A 9/1986 Banfi
4,612,430 A 9/1986 Sloan et al.
4,616,198 A 10/1986 Pardini
4,622,444 A 11/1986 Kandatsu et al.
4,631,625 A 12/1986 Alexander et al.
4,642,431 A 2/1987 Tedesco et al.
4,644,438 A 2/1987 Puccinelli et al.
4,649,247 A 3/1987 Preuss et al.
4,658,322 A 4/1987 Rivera
4,672,501 A 6/1987 Bilac et al.
4,675,481 A 6/1987 Markowski et al.
4,682,264 A 7/1987 Demeyer
4,689,712 A 8/1987 Demeyer
4,694,373 A 9/1987 Demeyer
4,710,845 A 12/1987 Demeyer
4,717,985 A 1/1988 Demeyer
4,733,211 A 3/1988 Castonguay et al.
4,733,321 A 3/1988 Lindeperg
4,764,650 A 8/1988 Bur et al.
4,768,007 A 8/1988 Mertz et al.
4,780,786 A 10/1988 Weynachter et al.
4,831,221 A 5/1989 Yu et al.
4,870,531 A 9/1989 Danek
4,884,047 A 11/1989 Baginski et al.
4,884,164 A 11/1989 Dziura et al.
4,900,882 A 2/1990 Bernard et al.
4,910,485 A 3/1990 Bolongeat-Mobleu et al.
4,914,541 A 4/1990 Tripodi et al.
4,916,420 A 4/1990 Bartolo et al.
4,916,421 A 4/1990 Pardini et al.
4,926,282 A 5/1990 McGhie
4,937,706 A 6/1990 Schueller et al.
4,939,492 A 7/1990 Raso et al.
4,943,888 A 7/1990 Jacob et al.
4,951,019 A 8/1990 Gula
4,952,897 A 8/1990 Barnel et al.
4,958,135 A 9/1990 Baginski et al.
4,965,543 A 10/1990 Batteux
4,983,788 A 1/1991 Pardini
5,001,313 A 3/1991 Leclercq et al.
5,004,878 A 4/1991 Seymour et al.
5,029,301 A 7/1991 Nebon et al.
5,103,198 A * 4/1992 Morel et al. ..... 335/6
5,281,776 A 1/1994 Morel et al.
5,296,660 A 3/1994 Morel et al.
5,296,664 A 3/1994 Crookston et al.
5,300,907 A 4/1994 Nereau et al.
5,310,971 A 5/1994 Vial et al.
5,313,180 A 5/1994 Vial et al.
5,317,471 A 5/1994 Izoard et al.
5,331,500 A 7/1994 Corcoles et al.
5,334,808 A 8/1994 Bur et al.
5,341,191 A 8/1994 Crookston et al.
5,347,096 A 9/1994 Bolongeat-Mobleu et al.
5,347,097 A 9/1994 Bolongeat-Mobleu et al.
5,350,892 A 9/1994 Rozier
5,357,066 A 10/1994 Morel et al.
5,357,068 A 10/1994 Rozier
5,357,394 A 10/1994 Piney
5,361,052 A 11/1994 Ferullo et al.
5,379,013 A 1/1995 Coudert
5,424,701 A 6/1995 Castonguary et al.
5,438,176 A 8/1995 Bonnardel et al.
5,440,088 A 8/1995 Coudert et al.
5,449,871 A 9/1995 Batteux et al.
5,450,048 A 9/1995 Leger et al.
5,451,729 A 9/1995 Onderka et al.
5,457,295 A 10/1995 Tanibe et al.
5,467,069 A 11/1995 Payet-Burin et al.
5,469,121 A 11/1995 Payet-Burin
5,475,558 A 12/1995 Barjonnet et al.
5,477,016 A 12/1995 Baginski et al.
5,479,143 A 12/1995 Payet-Burin
5,483,212 A 1/1996 Lankuttis et al.
5,485,343 A 1/1996 Santos et al.
5,493,083 A 2/1996 Olivier
5,504,284 A 4/1996 Laxareth et al.
5,504,290 A 4/1996 Baginski et al.
5,510,761 A 4/1996 Boder et al.
5,512,720 A 4/1996 Coudert et al.
5,515,018 A 5/1996 DiMarco et al.
5,519,561 A 5/1996 Mrenna et al.
5,534,674 A 7/1996 Steffens
5,534,832 A 7/1996 Duchemin et al.
5,534,835 A 7/1996 McDolloch et al.
5,534,840 A 7/1996 Cuingnet
5,543,595 A 8/1996 Mader et al.
5,552,755 A 9/1996 Fello et al.
5,581,219 A 12/1996 Nozawa et al.
5,604,656 A 2/1997 Derrick et al.
5,608,367 A 3/1997 Zeller et al.
5,784,233 A 7/1998 Bastard et al.

FOREIGN PATENT DOCUMENTS

DE 1 227 978 11/1966
DE 30 47 360 6/1982
DE 38 02 184 A1 8/1989
DE 38 43 277 A1 6/1990
DE 44 19 240 A1 1/1995
EP 0 061 092 A1 9/1982
EP 0 046 719 B1 4/1983
EP 0 117 094 A1 8/1984
EP 0 064 906 B1 9/1984
EP 0 140 761 A2 5/1985
EP 0 066 486 B1 10/1985
EP 0 196 241 A1 10/1986
EP 0 224 396 6/1987
EP 0 235 479 A1 9/1987
EP 0 239 460 A1 9/1987
EP 0 258 090 A1 3/1988
EP 0 264 313 A1 4/1988
EP 0 264 314 A1 4/1988
EP 0 283 189 A2 9/1988
EP 0 283 358 A1 9/1988
EP 0 291 374 A1 11/1988
EP 0 295 155 A1 12/1988
EP 0 295 158 A1 12/1988
EP 0 309 923 A2 4/1989
EP 0 313 106 A2 4/1989
EP 0 313 422 A1 4/1989
EP 0 314 540 A1 5/1989

| | | |
|---|---|---|
| EP | 0 331 586 A1 | 9/1989 |
| EP | 0 337 900 A1 | 10/1989 |
| EP | 0 342 133 A1 | 11/1989 |
| EP | 0 367 690 A1 | 5/1990 |
| EP | 0 371 887 A1 | 6/1990 |
| EP | 0 375 568 A1 | 6/1990 |
| EP | 0 394 144 A1 | 10/1990 |
| EP | 0 394 922 A1 | 10/1990 |
| EP | 0 407 310 A1 | 1/1991 |
| EP | 0 452 230 A1 | 10/1991 |
| EP | 0 555 158 B1 | 8/1993 |
| EP | 0 567 416 B1 | 10/1993 |
| EP | 0 595 730 A1 | 5/1994 |
| EP | 0 619 591 A1 | 10/1994 |
| EP | 0 665 569 A1 | 8/1995 |
| EP | 0 700 140 A1 | 3/1996 |
| FR | 2 410 353 | 6/1979 |
| FR | 2 512 582 | 3/1983 |
| FR | 0 553 943 | 4/1985 |
| FR | 2 592 998 | 7/1989 |
| FR | 2 697 670 | 5/1994 |
| FR | 2 699 324 | 6/1994 |
| FR | 2 714 771 | 7/1995 |
| GB | 2 233 155 | 1/1991 |
| RU | SU 1 227 978 | 4/1986 |
| WO | WO 92/00598 | 1/1992 |
| WO | WO 92/05649 | 4/1992 |
| WO | WO 49/00901 | 1/1994 |

* cited by examiner

PRESSURE SENSITIVE TRIP MECHANISM FOR CIRCUIT BREAKERS

CROSS REFERENCE TO RELATED APPLICATIONS

This application is a continuation-in-part of U.S. patent application Ser. No. 10/248,912, filed Feb. 28, 2003 now U.S. Pat. No. 6,919,785, pending, which is a continuation of U.S. patent application Ser. No. 09/682,319, filed Aug. 20, 2001 and allowed as U.S. Pat. No, 6,542,057 issued on Apr. 01, 2003, which is a continuation of U.S. patent application Ser. No. 09/571,810, filed May 16, 2000 and allowed as U.S. Pat. No. 6,373,357 issued on Apr. 16, 2002, all of which are incorporated by reference herein in their entirety.

BACKGROUND OF THE INVENTION

The present invention relates generally to circuit breakers and more particularly to a circuit breaker employing a pressure sensitive trip mechanism for instantaneously unlatching the circuit breaker operating mechanism in response to an overcurrent or short circuit condition.

Circuit breakers are one of a variety of overcurrent protective devices used for circuit protection and isolation. The basic function of a circuit breaker is to provide electrical system protection whenever an electrical abnormality occurs in any part of the system. In a rotary contact circuit breaker, electric current enters the system from a power source. The current passes through a line strap to a fixed contact fixed on the strap and then to a moveable contact. The moveable contact is fixedly attached to an arm, and the arm is mounted to a rotor that in turn is rotatably mounted in a cassette. As long as the fixed contact is in physical contact with the moveable contact, the current passes from the fixed contact to the moveable contact and out of the circuit breaker to downstream electrical devices.

In the event of an extremely high overcurrent condition (e.g. a short circuit), electro-magnetic forces are generated between the fixed and moveable contacts. These electro-magnetic forces repel the movable contact away from the fixed contact. Because the moveable contact is fixedly attached to a rotating arm, the arm pivots and physically separates the moveable contact from the fixed contact.

For a given model of circuit breaker, various types of trip units may be used. For example, mounted within a circuit breaker housing, a mechanical trip unit (e.g. thermal-magnetic or magnetic) can be employed. Alternatively, an electronic trip unit can also be employed that utilizes a current transformer. In order to trip the circuit breaker, the selected trip unit must activate a circuit breaker operating mechanism. Once activated, the circuit breaker operating mechanism separates a pair of main contacts to stop the flow of current in the protected circuit. Conventional trip units act directly upon the circuit breaker operating mechanism to activate the circuit breaker operating mechanism.

In all circuit breakers, the separation of the breaker contacts due to a short circuit causes an electrical arc to form between the separating contacts. The arc causes the formation of relatively high-pressure gases as well as ionization of air molecules within the circuit breaker. Exhaust ports are conventionally employed to vent such gasses in a rotary contact circuit breaker; each phase (pole) may employ two pairs of contacts, two contacts of which rotate about a common axis generally perpendicular to the current path from the line side to the load side of the circuit breaker. Each contact set in such an arrangement uses an exhaust port to expel gasses.

During an overcurrent or short circuit condition, it is desirable to trip the circuit breaker as quickly as possible in order to minimize the energy that the circuit breaker must absorb. For example, a very high level of arcing energy can develop when interrupting short circuits. Relatively severe, high level, and long lasting arcing can lead to excessive wear to the contacts as well as the arc chutes. Furthermore, if the circuit breaker can trip very quickly, higher interruption ratings can be achieved. With higher interruption ratings, overall circuit performance is improved. At the same time, the tripping system is used to protect the circuit breaker and the system in the event of a single-phase condition, e.g. where only one phase becomes overloaded. In a multi-phase system, a single-phase condition exists when one pole experiences a fault thereby blowing open and locking open the contacts of that pole. The remaining poles that do not experience the fault have their respective contacts remain closed. A single-phase condition is never desirable in a multi-phase system.

Therefore, it is desirable to provide a circuit breaker tripping mechanism that will trip a circuit breaker very quickly while providing protection of the circuit breaker and the electrical system should a single-phase condition occur.

BRIEF DESCRIPTION OF THE INVENTION

Embodiments of the invention include a circuit breaker having a set of electrical contacts, a first actuator in fluid communication with the set of electrical contacts, a second actuator in operable communication with the first actuator, and an operating mechanism in operable communication with the set of electrical contacts and the second actuator. Pressurized gas created by separation of the set of electrical contacts acts on and drives the first actuator, which acts on and drives the second actuator, which effectuates tripping of the operating mechanism.

Further embodiments of the invention include a circuit breaker having a first set of electrical contacts, a second set of electrical contacts, and means for separating the second set of electrical contacts in response to a predetermined level of pressurized gas created by separation of the first set of electrical contacts. The means for separating further includes means for separating the first and the second set of electrical contacts in response to the means for separating being mechanically actuated.

Additional embodiments of the invention include a circuit breaker having a base and a cover, a separable conduction path disposed within the base and the cover, and an operating mechanism disposed within the base and the cover and in operable communication with the separable conduction path. A first actuator is disposed in fluid communication with the separable conduction path, and a second actuator is disposed in operable communication with and between the first actuator and the operating mechanism. Pressurized gas created by separation of the separable conduction path acts on and drives the first actuator, which acts on and drives the second actuator, which effectuates tripping of the operating mechanism.

DETAILED DESCRIPTION OF THE INVENTION

Figure 1:
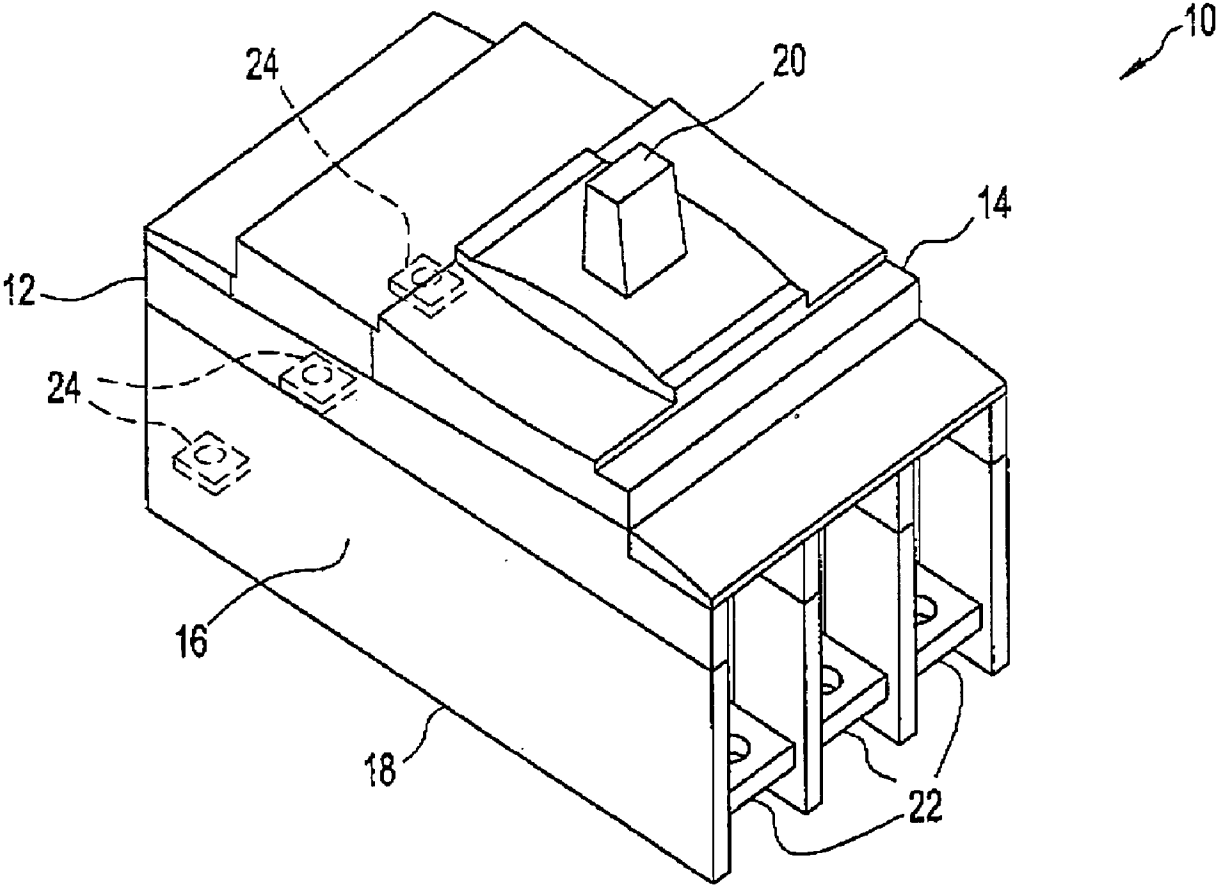
FIG. 1 is a perspective view of an exemplary circuit breaker for utilizing embodiments of the invention.

Referring to FIG. 1, an exemplary embodiment of a molded case circuit breaker 10 is generally shown. Circuit breakers of this type generally include an insulated case 16 having a cover 14 attached to a mid-cover 12 coupled to a base 18. A handle 20 extending through cover 14 gives the operator the ability to turn the circuit breaker 10 on (shown in FIG. 3) to energize a protected circuit (not shown), turn the circuit breaker off to disconnect the protected circuit, or reset the circuit breaker after a fault. A plurality of line-side contact and load-side connector straps 22, 24, respectively, extend through the case 16 for connecting the circuit breaker 10 to the line and load conductors of the protected circuit. The circuit breaker 10 in FIG. 1 shows a typical three phase configuration, however, embodiments of the present invention are not limited to this configuration but may be applied to other configurations, such as one, two or four phase circuit breakers, for example.

Figure 2:
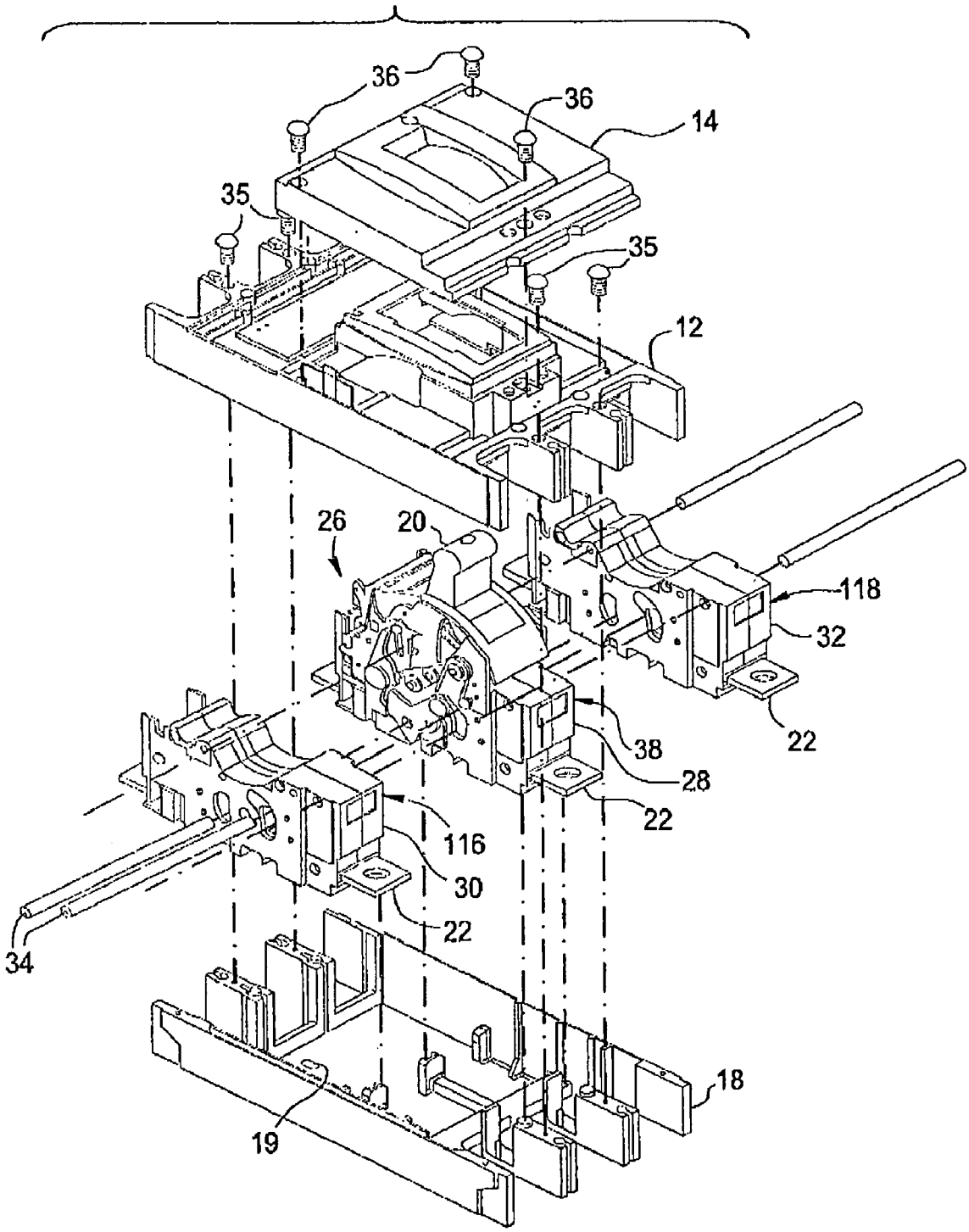
FIG. 2 is an exploded view of the circuit breaker of FIG. 1.

Referring to FIG. 2, the handle 20 is attached to a circuit breaker operating mechanism 26. The circuit breaker operating mechanism 26 is coupled with a center cassette (housing) 28 and is connected with outer cassettes (housings) 30 and 32 by drive pin 34. The cassettes 28, 30, and 32 along with the circuit breaker operating mechanism 26 are assembled into base 18 and retained therein by the mid-cover 12. The mid-cover 12 is connected to the base 18 by any convenient means, such as screws 35, snap-fit (not shown) or adhesive bonding (not shown). A cover 14 is attached to the mid-cover 12 by screws 36, or other suitable means.

Figure 3:
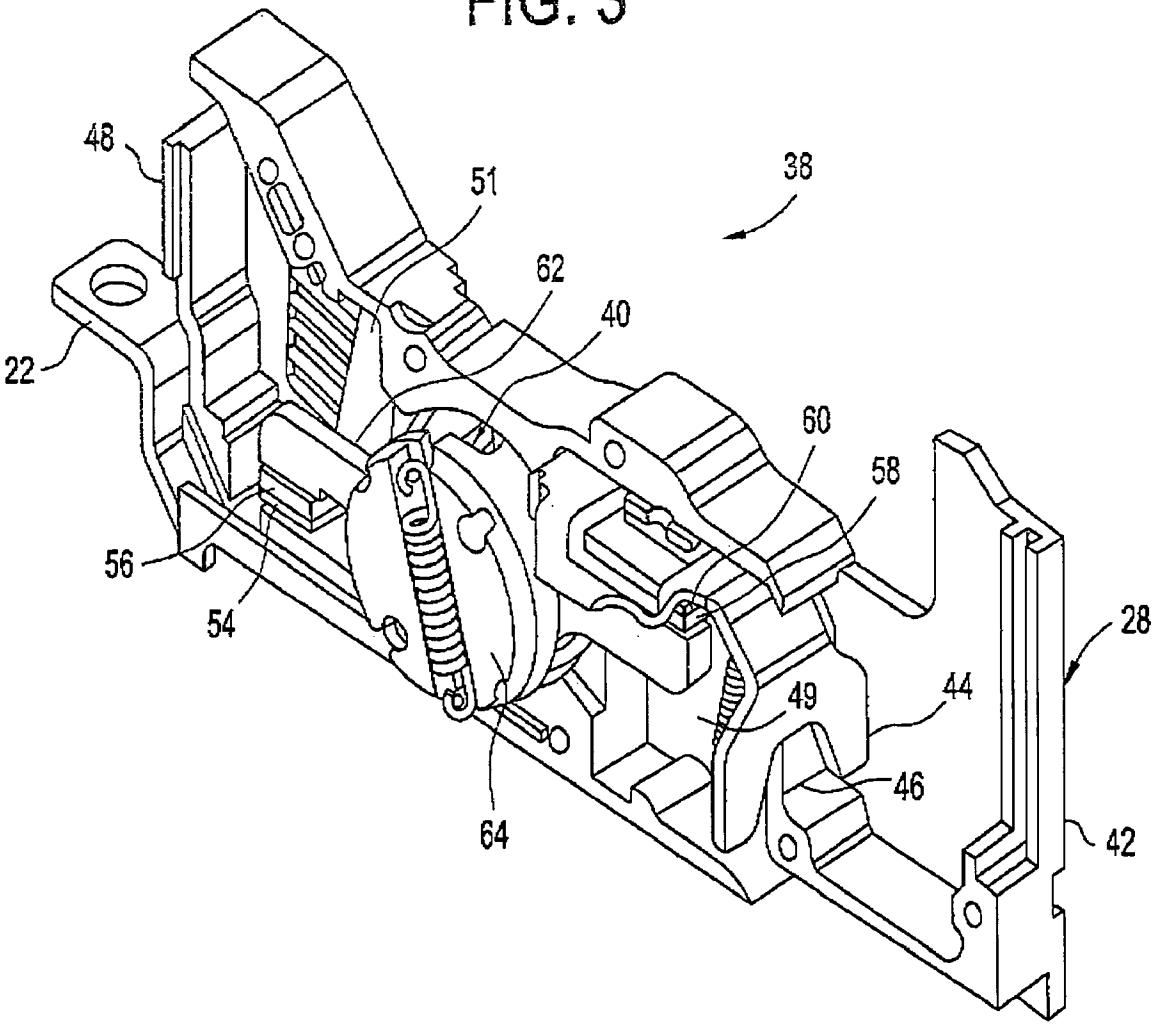
FIG. 3 is a perspective view of an exemplary circuit breaker cassette assembly for use in the circuit breaker of FIG. 1.

Referring to FIG. 3, a circuit breaker cassette assembly 38 is shown and comprises a rotary contact assembly, shown generally at 40, in a first electrically-insulative cassette half-piece 42 of center cassette 28 intermediate a line-side contact strap 22, and a load-side contact strap 44. Line-side contact strap 22 is electrically connectable to line-side wiring (not shown) in an electrical distribution circuit, and load-side contact strap 44 is electrically connectable to load-side wiring (not shown) via a lug (not shown) or a mechanism such as a bimetallic element or current sensor (not shown). Electrically insulative shields 46, 48 separate load-side contact strap 44 and line-side contact strap 22 from the associated arc chute assembly chambers 49, 51 for housing arc chute assemblies 50, 52, respectively, (best seen by referring to FIG. 5). Although only a single circuit breaker cassette assembly 38 is shown, a separate circuit breaker cassette assembly 38 may be employed for each pole of a multi-pole circuit breaker and operated in a manner similar to that of circuit breaker cassette assembly 38. Alternatively, one phase of circuit breaker 10 may employ multiple cassette assemblies 38 for increasing the amperage of circuit breaker 10 in a modular fashion.

Electrical transport through rotary contact assembly 40 of circuit breaker cassette assembly 38 occurs from line-side contact strap 22 to an associated first fixed contact 54, through first and second movable contacts 56, 58 secured to the ends of a movable contact arm, shown generally at 62, and to an associated second fixed contact 60 on load-side contact strap 44. Movable contact arm 62 is pivotally arranged between two halves of a rotor 64 and moves in conjunction with rotor 64 upon manual articulation of rotor 64. Rotor 64 is rotatably positioned on a rotor pivot axle 102 (shown below with reference to FIG. 5), the ends of which are supported by inner parallel walls of first electrically-insulative cassette half-piece 42. The combination of line-side contact strap 22, fixed contacts 54, 60, movable contacts 56, 58, contact arm 62, and load-side contact strap 44, may alternatively be viewed and referred to as a separable conduction path that may be opened and closed under the influence of operating mechanism 26.

The arc chute assemblies 50, 52 are positioned in the first electrically insulative cassette half piece 42 adjacent the respective pairs of first fixed and first moveable contacts 54, 56 and second fixed and second moveable contacts 60, 58. The first and second movable contacts 56, 58 and moveable contact arm 62 move through a passageway provided by the arc chute assemblies 50, 52 in order to engage and disengage from the respective first and second fixed contacts 54, 60. Each arc chute assembly 50, 52 is adapted to interrupt and extinguish the arc which forms when the circuit breaker 10 is opened or tripped and the first and second moveable contacts 56, 58 are separated from the first and second fixed contacts 54, 60.

Referring back to FIG. 2, it is understood that circuit breaker cassette assemblies 116, 118, having cassettes 30, 32, respectively, are similarly constructed to circuit breaker cassette assembly 38 having rotary contact assembly 40 described herein.

Figure 4:
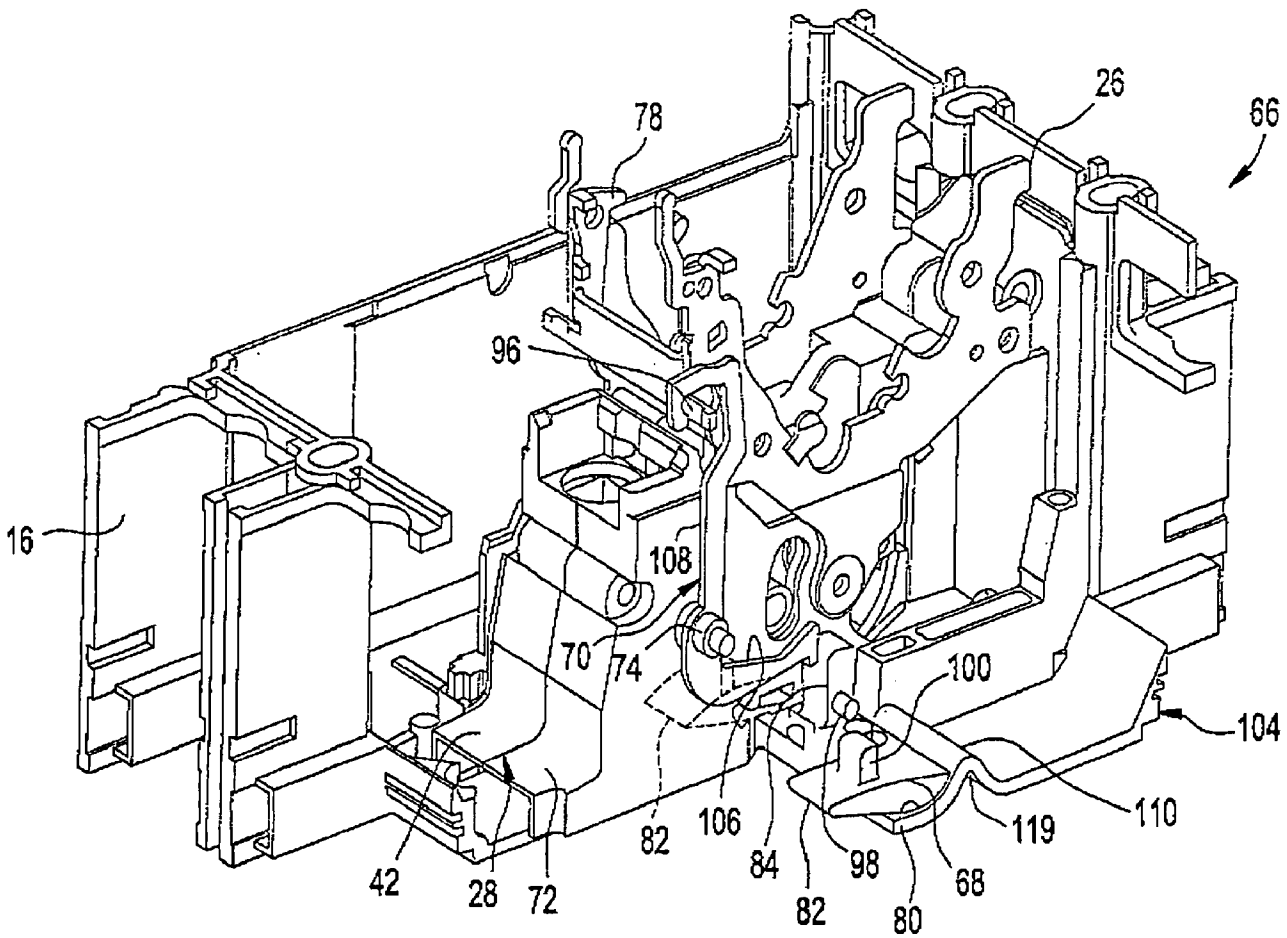
FIG. 4 is a perspective view of an exemplary pressure sensitive trip mechanism mounted onto the cassette of FIG. 3.

Referring to FIG. 4, an exemplary pressure sensitive trip mechanism (unit) 66 is shown mounted onto a second electrically insulative cassette half-piece 72. Center cassette 28 is formed by the mating of electrically insulative cassette half-piece 72 with first electrically insulative cassette half-piece 42. The pressure sensitive trip mechanism 66 comprises a trip bar (alternatively referred to as a first actuator) 68 and a trip lever (alternatively referred to as a second actuator) 70. Trip bar 68 has a base section 80 (best seen by referring to FIG. 5). Trip lever 70 comprises a first section 106 and a second section 108, and is rotatably mounted about a pivot 74 located on an exterior surface of center cassette 28. First section 106 of trip lever 70 extends in a generally horizontal direction adjacent the second electrically insulative cassette half-piece 72 from pivot 74 towards the center of the center cassette 28. Second section 108 of trip lever 70 extends in a generally vertical direction adjacent to the second electrically insulative cassette half-piece 72 from pivot 74 towards a latch assembly 78 at circuit breaker operating mechanism 26. Latch assembly 78 is actuatable by trip lever 70, and trip lever 70 is actuatable by the trip bar 68. Trip bar 68 is preferably molded of a high strength, high temperature thermoplastic. Trip lever 70 is preferably stamped from steel, but can also be molded of high strength plastic.

A bearing member 104 having a bearing surface 110, depicted in FIG. 4, is preferably integrally molded into the base 18 of the circuit breaker 10 and has generally a flattened and thin structure. Bearing surface 110 is positioned proximate to the bottom surface of base section 80 of the trip bar 68 and is molded and shaped to support the trip bar 68. A bend 119 is formed proximate to the base section 80. Bearing member 104 provides structural support to the trip bar 68 when the trip bar 68 is subjected to the high pressure forces of the arc gases.

Figure 5:
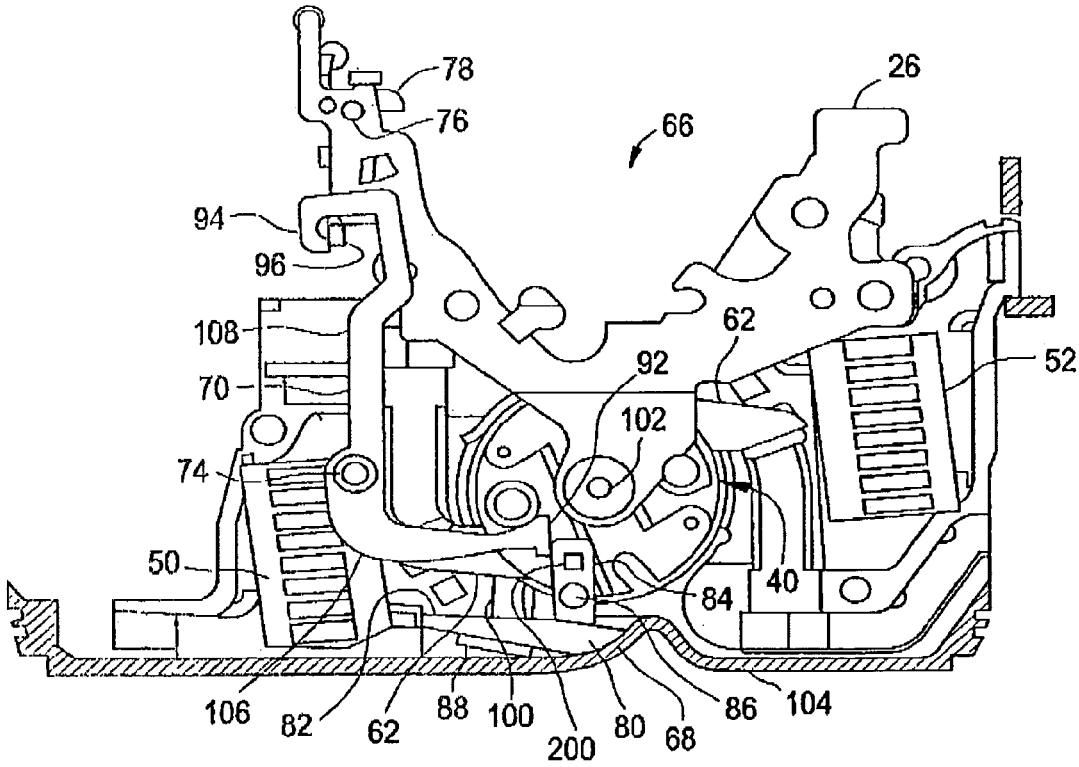
FIG. 5 is a side view of an exemplary trip bar and trip lever relative to an exemplary rotary contact assembly of the cassette of FIG. 3, showing the contacts in a tripped position.

Referring to FIG. 5, the pressure sensitive trip mechanism 66 will be described in further detail. The pressure sensitive trip mechanism 66 is shown positioned relative to contact arm 62 of the rotary contact assembly 40. Rotary contact assembly 40 is shown in an off position.

Base section 80 of trip bar 68 comprises at least one extension 82 extending from the base section 80, and a protrusion 84 extending outward, preferably perpendicularly, from base section 80. Trip bar 68 is rotatably mounted about a pivot 86 located on the exterior surface of the second electrically insulative cassette half-piece 72 (FIG. 2). Preferably, pivot 86 is a first pivot pin and most preferably, first pivot pin is made of metal. Pivot 86 is located on protrusion 84 and arranged for insertion into a corresponding opening (not shown) located within the exterior surface of the second electrically insulative cassette half-piece 72. The extension 82 of trip bar 68 extends through a corresponding opening 88 located generally in the lower section of the center cassette 28 (FIG. 1). Opening 88 is located proximate to the arc chute 50. Thus, extension 82, when extending inside the center cassette 28, is in gaseous communication with the arc chute 50. Preferably, base section 80 is generally flat and elongated in order to accommodate positioning proximate to cassettes 28, 30, 32.

Trip lever 70 is rotatably mounted about a pivot 74 located on the exterior surface of the second electrically insulative cassette half-piece 72 (FIG. 2). Trip lever 70 includes a free end 92 of first section 106. Free end 92 is proximate to protrusion 84. Trip lever 70 also includes a free end 94. Free end 94 is generally U-shaped so that movement of trip lever 70 in the clockwise direction moves a trip arm 96 in a direction to unlatch a latching mechanism 78.

For a multi-pole circuit breaker, each cassette 28, 30, 32 would have corresponding openings 88 located proximate to the respective arc chutes 50 in order that the extensions 82 (shown in phantom and solid lines in FIG. 4) extending from the base section 80 of trip bar 68 may extend through all cassettes being utilized.

Referring back to FIGS. 3, 4 and 5, the movement of the pressure sensitive trip mechanism 66 will now be detailed.

Under high-level short circuit or overcurrent faults, contact arm 62 is opened due to the magnetic forces at fixed and moveable contacts 54, 56, 58, 60. As the contact arm 62 is opened and the moveable contacts 56, 58 are separated from the fixed contacts 54, 60, a plasma arc is formed between the fixed and moveable contacts 54, 56, 58, 60. This arc generates arc gases of relatively high pressure within the center cassette 28.

Generally, the level of pressure created in center cassette 28 is proportional to the current and voltage levels of the fault. Once the pressure inside arc chute 50 reaches a predetermined level that is consistent with the desired overcurrent or short circuit overcurrent level for which a trip of circuit breaker 10 is desired, extension 82 of trip bar 68 will rotate counterclockwise about pivot 86 in response to the force exerted on it by the increased pressure (see FIG. 5). The rotation of trip bar 68 will cause radial protrusion 84 to make contact with, and apply a force against, free end 92 of trip lever 70. Trip lever 70, in reaction to the movement of trip bar 68, will rotate clockwise about pivot 74. Free end 94 of trip lever 70 then makes contact with trip arm 96 of latch assembly 78. Latch assembly 78 unlatches the circuit breaker operating mechanism 26 causing all phases of circuit breaker 10 to trip in response to the short circuit or overcurrent fault condition.

Incidentally, it will be appreciated that the pressure sensitive trip mechanism 66 can be arranged for use in a circuit breaker having a plurality of cassettes 28, 30, 32 as shown in FIG. 1, where each pole of a particular circuit breaker would utilize one extension 82 located along trip bar 68. Each respective extension 82 extending from trip bar 68 will react to the pressure created within the corresponding cassette 28, 30, 32. In this way, trip lever 70, located proximate to the center pole or mechanism pole, extension 82 of trip bar 68, as well as trip bar 68 itself, all respond to a fault condition in any pole of circuit breaker 10. When a high level short circuit or overcurrent fault occurs, the pole seeing the highest short circuit letthrough, and therefore highest arc gas pressure, will trip due to the pressure increase in the respective cassette 28, 30, 32. In this way, each pole employs trip bar 68 and trip lever 70. A trip of one pole moves latch assembly 78 thereby unlatching the circuit breaker operating mechanism 26. Once the circuit breaker operating mechanism 26 is unlatched, all contacts associated with the poles of circuit breaker 10 are opened by the circuit breaker operating mechanism 26 and the flow of electrical current through circuit breaker 10 is stopped.

Referring to FIG. 5, in a further exemplary embodiment of the invention, a trip finger 100 is employed with the trip bar 68 and trip lever 70 to mechanically trip the circuit breaker 10. In this embodiment of the present invention, at least one trip finger 100 protrudes outward from the trip bar 68, preferably in the same general direction as the protrusion 84. Trip finger 100 is located proximate to contact arm 62 on the load side of the cassette assembly 38.

Referring to FIGS. 2, 3 and 5, the manner in which the trip finger 100 operates relative to the rotary contact assembly 40 in order to mechanically trip the circuit breaker 10 will be detailed.

Under high-level short circuit or overcurrent faults, the contact arm 62 is opened due to the magnetic forces at the fixed and moveable contacts 54, 56, 58, 60. As the contact arm 62 is opened and the moveable contacts 54, 60 are separated from the fixed contacts 56, 58, the contact arm 62 rotates counterclockwise about rotor axle pivot 102. The rotation of the contact arm 62 causes the contact arm 62 to make contact with trip finger 100 located on trip bar 68. Trip bar 68 will then rotate counterclockwise about pivot 86 in response to the force exerted on the trip finger 100. The rotation of trip bar 68 will cause protrusion 84 to make contact with, and apply force against, free end 92 of trip lever 70. The trip lever 70, in reaction to the movement of trip bar 68, will rotate clock-wise about pivot 74. The free end 94 of trip lever 70 then makes contact with the trip arm 96 of the latch assembly 78. Latch assembly 78 rotates counterclockwise about pivot 76 to unlatch the circuit breaker operating mechanism 26 causing all phases of the circuit breaker to trip in response to the short circuit or overcurrent fault condition.

Figure 6:
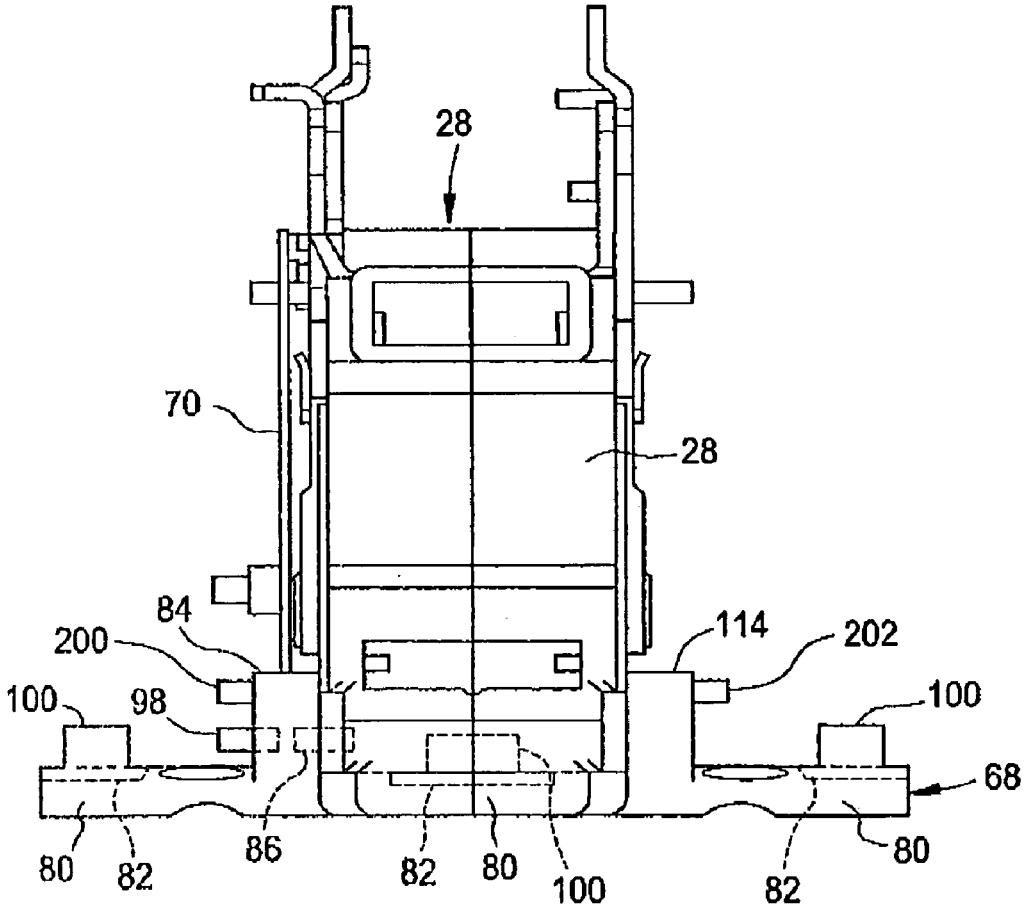
FIG. 6 is a front end view of a center cassette and the trip bar of FIG. 5.

Referring to FIG. 6, the line-side front end view of the center cassette 28 relative to the trip bar 68 is shown. It will be appreciated that in a multi-pole circuit breaker, the number of trip fingers 100 utilized on the trip bar 68 will correspond to the number of poles for a particular circuit breaker. Each pole or phase of the circuit breaker would utilize one trip finger 100 located along trip bar 68. For example, and referring also to the three pole circuit breaker 10 shown in FIG. 2, trip bar 68 would have three extensions 82 and three trip fingers 100. In this way, each contact arm 62 (FIG. 3) employed in a multi-pole circuit breaker individually acts upon the respective trip finger 100 located on the base section 80 of trip bar 68. Each respective trip finger 100 will be located proximate to the corresponding contact arm 62. When a high level short circuit or overcurrent fault occurs, the pole seeing the highest short circuit letthrough will trip as a result of the respective contact arm 62 blowing open and making contact with the respective trip finger 100. In this way, each pole employs the base section 80 and protrusion 84 of the trip bar 68 as well as the trip lever 70. A trip of one pole moves the latch assembly 78 (FIG. 5) thereby unlatching the circuit breaker operating mechanism 26. Once the circuit breaker operating mechanism 26 is unlatched, all contacts associated with the poles of the circuit breaker 10 open, and the flow of electrical current through the circuit breaker 10 is stopped. In an embodiment where more than one phase and more than one extension 82 may be present, one of the additional extensions 82 may also be referred to as a third actuator.

Referring to FIGS. 2, 3, 5 and 6, it is further noted and within the scope of the invention that in the multi-pole circuit breaker 10, a second pivot pin 98, in addition to the first pivot pin 86, may be utilized on protrusion 84 of trip bar 68 to fit into a corresponding opening (not shown) in the exterior surface of the outer cassette 30. In an embodiment, first and second pivot pins 86, 98 would be steel pins press fit into blind holes of protrusion 84, thereby providing phase-to-phase electrical isolation between cassettes 28 and 30. Also, a second protrusion 114 may extend outward from base section 80 and be positioned proximate the center cassette 28 and the third cassette 32. Second protrusion 114 may utilize a third pivot pin (not shown) for insertion into a corresponding opening (not shown) in the exterior surface of first electrically-insulative cassette half-piece 42 of center cassette 28. Second protrusion 114 may also utilize a fourth pivot pin (not shown) for insertion into a corresponding opening (not shown) in the exterior surface of outer cassette 32. In an embodiment, third and fourth pivot pins (not shown) would be steel pins press fit into blind holes of protrusion 114, thereby providing phase-to-phase electrical isolation between cassettes 28 and 32. In this manner, first and second pivot pins 86, 98 at protrusion 84 and third and fourth pivot pins (not shown) at protrusion 114, would provide pivotal stability to trip bar 68 relative to cassettes 28, 30, 32.

As described herein, the pressure sensitive trip mechanism 66 for actuating a circuit breaker operating mechanism to trip a circuit breaker includes a trip lever 70 and a trip bar 68 and is readily adaptable to a variety of circuit breakers. The pressure sensitive trip mechanism 66 provides for very fast tripping of the circuit breaker 10 in the event of a short circuit condition or an overcurrent fault condition within any one of the circuit breaker poles. Fast response time to trip the circuit breaker 10 is achieved due to the close proximity of the trip bar 68 and extensions 82 to the source of the high pressure generated within the cassettes 28, 30, 32. Thus, the pressure sensitive trip mechanism 66 will cause the circuit breaker to trip should any one phase in a multi-phase circuit breaker blow open before the trip unit (e.g. mechanical or electronic) can react and trip the circuit breaker. Fast tripping during a short circuit condition protects the fixed and movable contacts 54, 56, 58, 60 and arc chutes 50, 52 from excessive wear due to extended exposure to high arcing energy. Finally, bearing member 104 provides structural support for the trip bar 68 and ensures that the high pressure force acting on the trip bar 68 is translated into a rotational force that rotates the trip bar 68.

Referring to FIGS. 5 and 6, in an alternative exemplary embodiment of the invention, an actuation finger (alternatively referred to as a mechanical actuation arm) 200 is integrally formed on trip bar 68 on the opposite side of pivot 86 to extension 82, and extends substantially perpendicular to protrusion 84, as seen in FIG. 6. In an embodiment, actuation finger 200 is accessible during the assembly of circuit breaker 10, but not accessible subsequent to the final assembly of cover 14 onto mid-cover 12. Upon the assembly of cassettes 28, 30, 32 into base 18, see FIG. 2, a trip tool (not shown, but such as a long shank flat blade screw driver for example) may be inserted at the load-side end of circuit breaker 10 between cassettes 28 and 30 to interact with actuation finger 200 and to exert a force thereon. Similar to actuation finger 200, a second actuation finger 202 may be integrally formed on trip bar 68 extending substantially perpendicular from protrusion 114, such that the trip tool may be inserted at the load-side end of circuit breaker 10 between cassettes 28 and 32 to interact with second actuation finger 202 and to exert a force thereon. By applying a force to actuation finger 200 in such a manner as to rotate trip bar 68 in a counterclockwise direction, best seen by referring to FIG. 5, trip bar 68 will rotate about pivot 86 causing trip lever 70 to rotate clockwise about pivot 74 and latch assembly 78 to rotate counterclockwise about pivot 76, thereby unlatching circuit breaker operating mechanism 26 causing all phases of the circuit breaker to trip in response to a mechanical trip action by the trip tool.

Figure 7:
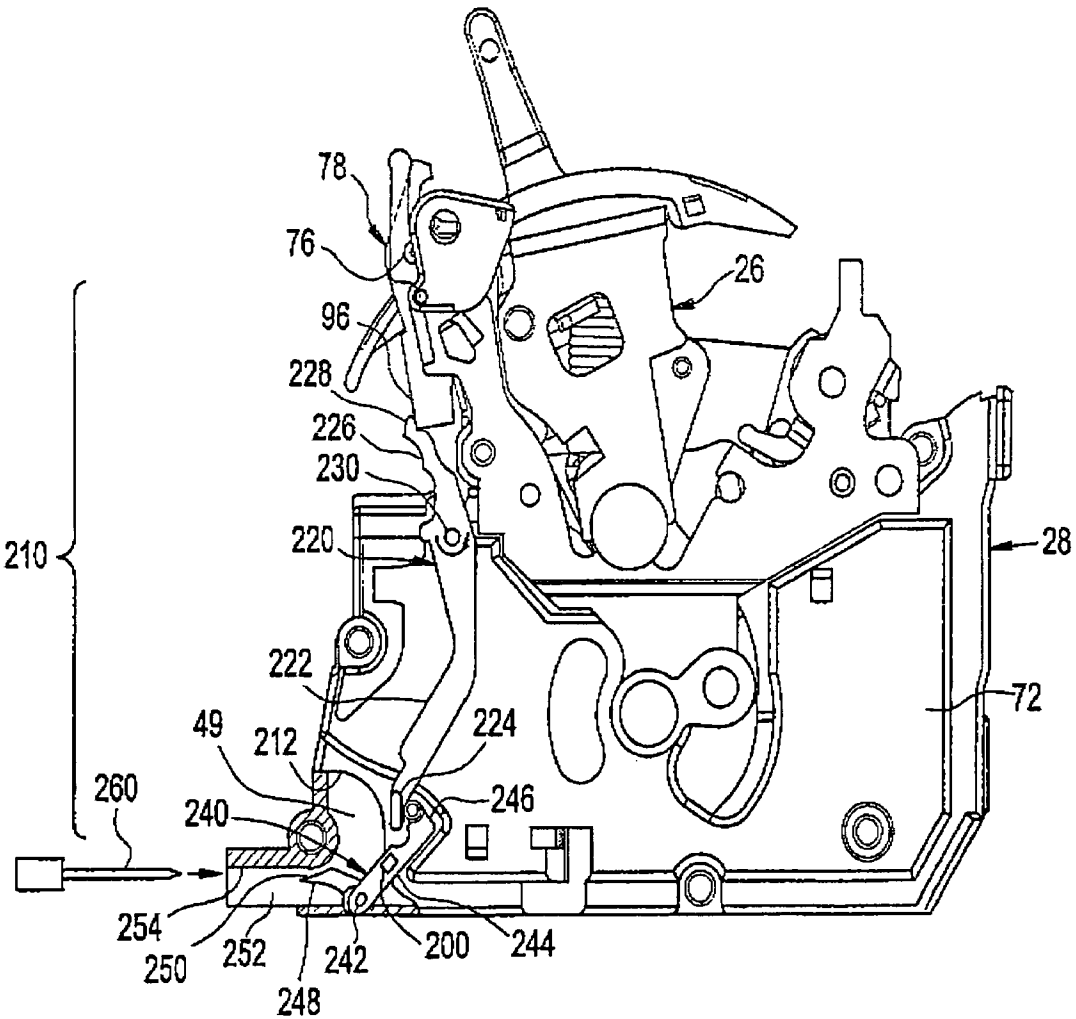
FIG. 7 is a side view of an alternative trip bar and trip lever arrangement similar to that of FIG. 5.

Referring now to FIG. 7, an alternative pressure trip mechanism 210 to that of pressure trip mechanism 66, with mechanical trip action, will now be described. FIG. 7 depicts a side view of cassette 28 similar to that depicted in FIG. 5, except with cassette half piece 72 only partially removed, depicted as cutaway 212. A trip lever (alternatively referred to as a second actuator) 220, similar to trip lever 70, is pivotally attached to cassette half piece 72 at pivot 230 and is biased in a counterclockwise direction thereabout. Trip lever 220 has a first section 222 that extends substantially downward from pivot 230 to free end 224, and a second section 226 that extends substantially upward from pivot 230 to a free end 228. A trip bar (alternatively referred to as a first actuator) 240 is pivotally attached to cassette half piece 72 at pivot 242. Trip bar 240 includes a first extension 244 that extends to free end 246 external to cassette 28, and a second extension 248 that extends to free end 250 internal to cassette 28. Second extension 248 is disposed in fluid communication with and between arc chute chamber 49 and exhaust port 252. First and second extensions 244, 248 are coupled together so as to move in unison about pivot 242. Free end 228 of trip lever 220 interacts with trip arm 96 of latching mechanism 78 in a manner similar to that discussed previously to trip operating mechanism 26 on command. Free end 224 of trip lever 220 interacts with free end 246 of trip bar 240 in a manner now to be discussed.

In a quiescent state with operating mechanism 26 latched and turned ON, latching mechanism 78 biases trip arm 96 clockwise about pivot 76 to interact with free end 228 of trip lever 220. Trip lever 220 is biased counterclockwise about pivot 230 resulting in free end 224 of trip lever 220 interacting with free end 246 of trip bar 240. In response to this interaction, second extension 248 is biased clock-wise about pivot 242 into a closed position where free end 250 closes off a gas flow channel between arc chute chamber 49 and exhaust port 252 as defined by cassette half pieces 42, 72.

Under a short circuit condition, contact arm 62 blows open to separate movable contacts 56, 58 from fixed contacts 54, 60, resulting in an electric arc being driven into arc chutes 50, 52, and arc chute chambers 49, 51 being pressurized with arc gases. The pressure differential between arc chute chamber 49 and exhaust port 252 results in a gas pressure being applied to second extension 248 that drives trip bar 240 counterclockwise about pivot 242, and drives free end 246 of first extension 244 into free 224 of first section 222. The interaction between free ends 246 and 224 results in trip lever 220 being driven clockwise about pivot 230 to trip operating mechanism 26 in a manner similar to that discussed previously.

The resetting of operating mechanism 26 serves to reposition trip arm 96, trip lever 220, and trip bar 240 into the quiescent position depicted in FIG. 7.

Similar to the previous discussion regarding the insertion of a trip tool at the load-side end of circuit breaker 10 between cassettes 28 and 30 to interact with actuation finger 200 and to exert a force thereon (see FIGS. 5 and 6) to effectuate tripping of operating mechanism 26, a similar trip tool 260 (not to scale) may be inserted into exhaust port 252 between exhaust port wall 254 and free end 250 to drive trip bar 240 counterclockwise about pivot 242, thereby enabling a mechanical trip of operating mechanism 26 via pressure trip mechanism 210. When used to mechanically trip operating mechanism 26, second extension 248 may be viewed as a mechanical actuation arm.

As an alternative to mechanical actuation arm 248, first extension 244 of trip bar 240 may include an actuation finger 200, similar to that discussed previously in relation to FIGS. 5 and 6. Here, actuation finger 200 is integral with first extension 244, disposed between pivot 242 and free end 246, and is arranged sideways perpendicular to first extension 244. With cassette 28 installed in base 18, an access hole 19 in base 18, best seen by referring to FIG. 2, provides access for a trip tool 260 to be used for reaching inside base 18 to exert a trip force on actuation finger 200. Access hole 19 is arranged in base 18 such that a counterclockwise movement of trip bar 240 about pivot 242 may be achieved by pushing trip tool 260 against actuation finger 200. Access hole 19 may be left open after final assembly of circuit breaker 10, or sealed closed using a suitable potting compound.

Similar to the previous discussion regarding multiple cassettes 28, 30, 32 each having extension 82 for effectuating single-phase or multi-phase tripping of a multi-pole circuit breaker 10, a similar arrangement may be adopted with pressure trip mechanism 210 where multiple cassettes 28, 30, 32 each have second extension 248 for transmitting a trip signal to first extension 244 to effectuate single-phase or multi-phase tripping. The transmission of torque from second extension 248 at outside cassette 30, 32 to center cassette 28 may be accomplished by using a keyed pivot pin at pivot 242, or by any other suitable means for transmitting a torque. In an embodiment where more than one phase and more than one second extension 248 may be present, one of the additional second extensions 248 may also be referred to as a third actuator. In an embodiment having multiple extensions 248 for multiple phases of circuit breaker 10, a keyed pivot pin at pivot 242 would serve to couple all extensions 248 together on trip bar 240, such that movement at one extension 248 would result in movement at the other extensions 248, as well as resulting in movement at first extension 244.

In an embodiment, actuation finger 200, second actuation finger 202, and second extension 248, may be accessible by the trip tool prior to the assembly of midcover 12 and cover 14 onto base 18, but may not be accessible by the same subsequent to the assembly of midcover 12 and cover 14 onto base 18. In this manner, trip bar 68, 240 may be accessed during the assembly of circuit breaker 10 to ensure proper operation of pressure trip mechanism 66, 210 by an authorized operator, but may not be accessed in a customer installation by an unauthorized user, thereby avoiding inadvertent damage to pressure trip mechanism 66, 210.

While the invention has been described with reference to exemplary embodiments, it will be understood by those skilled in the art that various changes may be made and equivalents may be substituted for elements thereof with-out departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A circuit breaker comprising:

a base and a cover;

a set of electrical contacts;

a first actuator in fluid communication with the set of electrical contacts;

a second actuator in operable communication with the first actuator; and an operating mechanism in operable communication with the set of electrical contacts and the second actuator;

wherein pressurized gas created by separation of the set of electrical contacts acts on and drives the first actuator, which acts on and drives the second actuator, which effectuates tripping of the operating mechanism; and wherein the first actuator comprises a mechanical actuation arm accessible by a trip tool prior to assembly of the cover onto the base.

2. The circuit breaker of claim 1, wherein:

the mechanical actuation arm is not accessible by the trip tool subsequent to assembly of the cover onto the base.

3. The circuit breaker of claim 1, further comprising:

a cassette configured to house the set of electrical contacts;

wherein the mechanical actuation arm is accessible external to the cassette.

4. The circuit breaker of claim 1, further comprising:

a cassette configured to house the set of electrical contacts and defining an exhaust port in fluid communication with the set of electrical contacts;

wherein the mechanical actuation arm is accessible via the exhaust port.

5. The circuit breaker of claim 1, wherein the first actuator is rotatably disposed at a housing, the set of electrical contacts being disposed in the housing.

6. The circuit breaker of claim 1, wherein:

an electrical contact in the set of electrical contacts is mounted on an arm; and the first actuator is responsive to the arm in response to the set of electrical contacts being separated under a short circuit condition.

7. The circuit breaker of claim 1, comprising:

a first separable conduction path comprising the set of electrical contacts and being associated with a first phase of an electrical circuit;

a second separable conduction path comprising a second set of electrical contacts and being associated with a second phase of the electrical circuit; and a third actuator in fluid communication with the second set of electrical contacts;

wherein the third actuator is in operable communication with the second actuator;

wherein the operating mechanism is in operable communication with the second set of electrical contacts; and wherein pressurized gas created by separation of the second set of electrical contacts acts on and drives the third actuator, which acts on and drives the second actuator, which effectuates tripping of the operating mechanism.

8. The circuit breaker of claim 7, wherein the third actuator is coupled to the first actuator.

9. The circuit breaker of claim 1, wherein:

the base comprises and access hole; and the mechanical actuation arm is accessible by a trip tool subsequent to assembly of the cover onto the base.

10. A circuit breaker comprising:

a base and a cover;

a first set of electrical contacts;

a second set of electrical contacts; and means for separating the second set of electrical contacts in response to a predetermined level of pressurized gas created by separation of the first set of electrical contacts;

wherein the means for separating further comprises means for separating the first and the second set of electrical contacts in response to the means for separating being mechanically actuated; and wherein the means for separating is accessible via a tool in the absence of the cover being assembled onto the base.

11. The circuit breaker of claim 10, wherein:

the means for separating is not accessible via a mechanical tool in the presence of the cover being assembled onto the base.

12. The circuit breaker of claim 10, comprising:

means for supporting the first set of electrical contacts;

wherein the means for separating is accessible via a mechanical tool external to the means for supporting.

13. The circuit breaker of claim 10, further comprising:

means for supporting the first set of electrical contacts, the means for supporting comprising means for exhausting arc gas;

wherein the means for separating is accessible via a mechanical tool internal to the means for exhausting.

14. The circuit breaker of claim 10, wherein the means for separating further comprises:

means for separating the second set of electrical contacts in response to a predetermined level of short circuit current at the first set of electrical contacts resulting in a blow open separation thereof and a mechanical impact at the separation means.

15. The circuit breaker of claim 10, wherein:

the base comprises an access hole; and the means for separating is accessible via a mechanical tool inserted through the access hole subsequent to the cover being assembled onto the base.

16. A circuit breaker comprising:

a base and a cover;

a separable conduction path disposed within the base and the cover;

an operating mechanism disposed within the base and the cover and in operable communication with the separable conduction path;

a first actuator in fluid communication with the separable conduction path;

a second actuator in operable communication with and between the first actuator and the operating mechanism;

a first cassette housing the separable conduction path and the first actuator; and a second cassette housing a second separable conduction path and a third actuator, the third actuator in fluid communication with the second parable conduction path and in operable communication with the second actuator;

wherein pressurized gas created by separation of the separable conduction path acts on and drives the first actuator, which acts on and drive the second actuator, which effectuates tripping of to operating mechanism; and wherein pressurized gas created by separation of the second separable conduction path acts on and drives the third actuator, which acts on and drives the second actuator, which effectuates tripping of the operating mechanism.

17. The circuit breaker of claim 16, wherein:

the first actuator comprises an actuation finger responsive to a mechanical force for tripping to operating mechanism, the actuation finger being accessible external to the first cassette prior to assembly of the cover onto the base, and not accessible subsequent to assembly of the cover onto the base.

18. The circuit breaker of claim 17, wherein:

the third actuator comprises a second actuation flag responsive to a mechanical force for tripping to operating mechanism, the second actuation finger being accessible external to the second cassette prior to assembly of the cover onto the base, and not accessible subsequent to assembly of the cover onto the base.

19. The circuit breaker of claim 18, wherein:

the first actuator and the third actuator are coupled together such that movement at one results in movement at the other.

20. A multi-pole circuit breaker comprising:

a plurality of separable conduction paths, each having a pressure sensitive actuator in fluid communication with the respective separable conduction path;

an operating mechanism common to and in operable communication with the plurality of separable conduction paths; and a trip actuator in operable communication with and between the plurality of pressure sensitive actuators and the operating mechanism;

wherein pressurized gas created by separation of a first of the plurality of separable conduction paths acts on and drives a first of the plurality of pressure sensitive actuators, which acts on and drives the trip actuator, which effectuates tripping of the operating mechanism; and wherein pressurized gas created by separation of a second of the plurality of separable conduction paths acts on and drives a second of the plurality of pressure sensitive actuators, which acts on and drives the trip actuator, which effectuates tripping of the operating mechanism.

* * * * *

UNITED STATES PATENT AND TRADEMARK OFFICE

CERTIFICATE OF CORRECTION

PATENT NO. : 6,995,640 B2
DATED : February 7, 2006
INVENTOR(S) : Harmon et al.

It is certified that error appears in the above-identified patent and that said Letters Patent is hereby corrected as shown below:

Column 10,
Line 12, after "thereof" delete "with-out" and insert -- without --.

Column 12,
Line 19, after "second" delete "parable" and insert -- separable --.
Line 24, after "and" delete "drive" and insert -- drives --.
Lines 36 and 44, after "tripping" delete "to" and insert -- the --.
Line 43, after "actuation" delete "flag" and insert -- finger --.

Signed and Sealed this

Sixth Day of June, 2006

JON W. DUDAS
*Director of the United States Patent and Trademark Office*